US005823446A

United States Patent [19]

Bennett et al.

[11] Patent Number: 5,823,446

[45] Date of Patent: Oct. 20, 1998

[54] FUEL INJECTOR VALVE FOR LIQUIFIED FUEL

[75] Inventors: David E. Bennett, Lake Lillian, Minn.; Devlin A. Hunt; Ronald H. Roche, both of Cass City, Mich.

[73] Assignee: Awalbro Corporation, Cass City, Mich.

[21] Appl. No.: 801,493

[22] Filed: Feb. 18, 1997

[51] Int. Cl.[6] ..... F02M 51/08

[52] U.S. Cl. ..... 239/585.1; 239/900

[58] Field of Search ..... 239/585.1, 585.5, 239/600, 124, 127, 400

[56] References Cited

U.S. PATENT DOCUMENTS

| | | | |
|---|---|---|---|
| 2,969,926 | 1/1961 | Peeps | 239/124 X |
| 3,561,730 | 2/1971 | Hurst | 251/315 |
| 4,134,428 | 1/1979 | Bjorklund | 239/124 X |
| 4,509,693 | 4/1985 | Nakai | 239/585.5 |
| 4,711,400 | 12/1987 | Radaelli et al. | 239/585.4 |
| 4,946,107 | 8/1990 | Hunt | 239/585.4 |
| 4,982,902 | 1/1991 | Knapp et al. | 239/124 X |
| 5,277,400 | 1/1994 | Bierther | 239/585.4 X |
| 5,291,869 | 3/1994 | Bennett . | |

FOREIGN PATENT DOCUMENTS

| | | | |
|---|---|---|---|
| 3434840 | 4/1986 | Germany | 239/585.4 |
| 4-191443 | 7/1992 | Japan | 239/124 |
| 2039993 | 8/1980 | United Kingdom | 239/585.4 |

*Primary Examiner*—Kevin Weldon

*Attorney, Agent, or Firm*—Barnes, Kisselle, Raisch, Chaote, Whittemore & Hulbert, P.C.

[57] ABSTRACT

A solenoid actuated fuel injector for liquified petroleum gas (LPG), compressed natural gas (CNG) or the like has a fuel passage therethrough and a valve to control the flow of fuel through the fuel passage. The valve has a valve head formed of a generally flexible and substantially resilient material engageable with a valve seat to prevent fuel flow through the injector. The valve is preferably spring biased to a closed position which compresses the valve head against the valve seat to prevent fuel flow between them. Compression of the valve head is preferably limited by contact between the metal valve body and the metal valve seat which limits the travel of the valve body relative to the valve seat. The valve head and valve seat are also constructed to be highly resistant to wear to provide a consistent seal between them. The valve head preferably engages the valve seat over a limited surface area to facilitate disengaging the valve head from the valve seat so that the force provided by the solenoid will be sufficient to accurately move the valve to its open and closed positions.

17 Claims, 3 Drawing Sheets

FUEL INJECTOR VALVE FOR LIQUIFIED FUEL

FIELD OF THE INVENTION

This invention relates generally to fuel injectors for an internal combustion engine and more particularly to a fuel injector for liquified gaseous fuels.

BACKGROUND OF THE INVENTION

Solenoid actuated fuel injectors can be used to control the fuel supply to an internal combustion engine. Some fuel injectors have a valve which is movable to open and closed positions to control when fuel is delivered from the fuel injector to an intake manifold of the engine. The valve must completely seal off the outlet of the fuel injector when fuel flow is not desired and leakage through the fuel injector valve results in inconsistent engine operation and unacceptable exhaust emissions from the engine, particularly at low engine speeds and loads such as when the engine is idling. Further, it is undesirable for fuel to leak through the injector and eventually into the engine when the engine is being shut down.

In gasoline powered internal combustion engines the fuel pressure within the system is typically in the range of about 30–60 psi which allows adequate sealing of the fuel injector with hardened metal valves. However, when using liquified petroleum gas (LPG) or liquified compressed natural gas (CNG) the pressures are considerably higher that for gasoline, and typically are 100–150 psi for CNG and can be over 300 psi for LPG. Current metal fuel injector valves cannot sufficiently seal the fuel injector when operating with liquified fuels such as LPG or CNG which are at elevated pressures compared to gasoline. In addition, to provide a sufficient seal of the fuel injector under the higher pressures of liquified LPG or CNG and allow current solenoids to be used, the sealing surface area must be decreased so that the limited magnetic force available from the solenoid can precisely move the valve and effectively meter the flow of fuel through the injector.

SUMMARY OF THE INVENTION

A solenoid actuated fuel injector for liquified petroleum gas (LPG), compressed natural gas (CNG) or other liquified fuel has a fuel passage therethrough and a valve to control the flow of fuel through the fuel passage which has a valve head formed of generally flexible and substantially resilient material engageable with a valve seat to prevent fuel flow through the valve and thereby prevent fuel flow through the fuel injector. The valve is preferably spring biased to a closed position compressing the valve head against the valve seat to prevent fuel flow between them. Compression of the valve head is preferably limited by contact between the metal valve body and the metal valve seat which limits the travel of the valve body relative to the valve seat. The valve head and valve seat are also constructed to be highly resistant to wear to provide a consistent seal between them. The valve head preferably engages the valve seat over a limited surface area to facilitate disengaging the valve head from the valve seat so that the force provided by the solenoid in currently used solenoid actuated gasoline fuel injectors is sufficient to accurately move the valve to open and closed positions.

The valve seat is preferably a face of a metering body with a metering orifice formed therein such that engagement of the valve head with the metering body prevents fuel flow through the metering orifice. The valve head is preferably spherical or ball shaped and at least partially received in a pocket adjacent the bottom of the valve body such that it extends slightly below the valve body to allow the valve head to be compressed to seal the passage of the metering orifice.

Object, features and advantages of this invention include providing a liquified fuel injector valve having a generally flexible and substantially resilient valve head which prevents fuel flow through the valve when the valve head is engaged with the valve seat to control when fuel is emitted from the fuel injector, can be used with fuels under high pressure such as liquified petroleum gas and compressed natural gas, prevents leakage of even high pressure gases through the injector, provides a seal of the fuel passage of the fuel injector over a limited surface area so that currently used solenoids can displace the valve to accurately meter the fuel emitted from the fuel injector, limits the compression of the valve head, inhibits wear of both the valve head and metering orifice to maintain a consistent fuel flow through the orifice when the valve is open, provides a consistent and controllable fuel flow through the fuel injector, maintains a consistent seal over extended periods of time such as when the engine is shut-off and high pressure gaseous fuel remains within the fuel injector, can be used with various liquified gas fuels at various pressures, is durable, reliable, of relatively simple design and economical manufacture, and has a long, useful life in-service.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE PREFERRED EMBODIMENT

Figure 1:
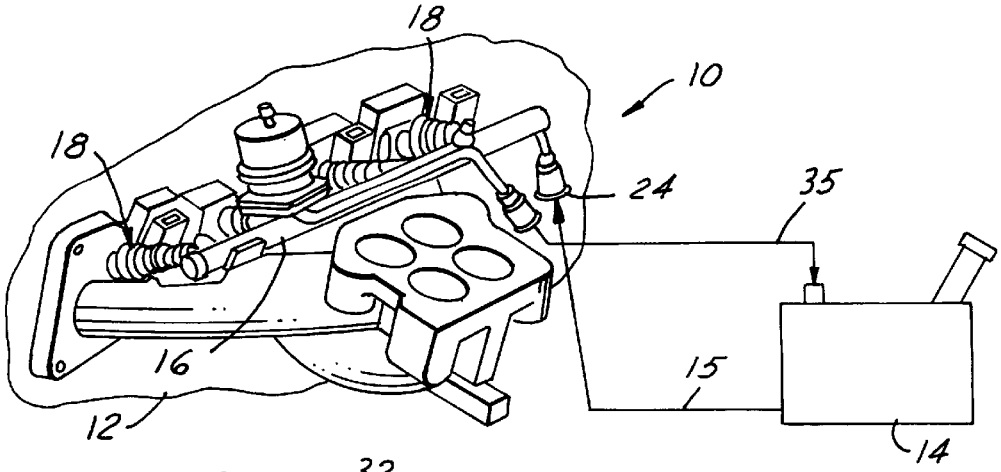
FIG. 1 is a partial perspective view illustrating a simplified liquified fuel delivery system for an internal combustion engine.

Referring in more detail to the drawings, FIG. 1 shows a simplified fuel delivery system 10 for an internal combustion engine 12 having a fuel tank 14 to supply fuel, including fuels under relatively high pressure such as liquified petroleum gas (LPG) and liquified compressed natural gas (CNG), through a supply line 15 to a fuel rail 16 and associated solenoid actuated fuel injectors 18 each having a valve head of a flexible material to control delivery of the fuel to the engine 12. The fuel rail 16 acts as a manifold to distribute fuel to the fuel injectors 18 of the system 10 so that the fuel injectors 18 can deliver that fuel to power the engine 12.

Figure 2:
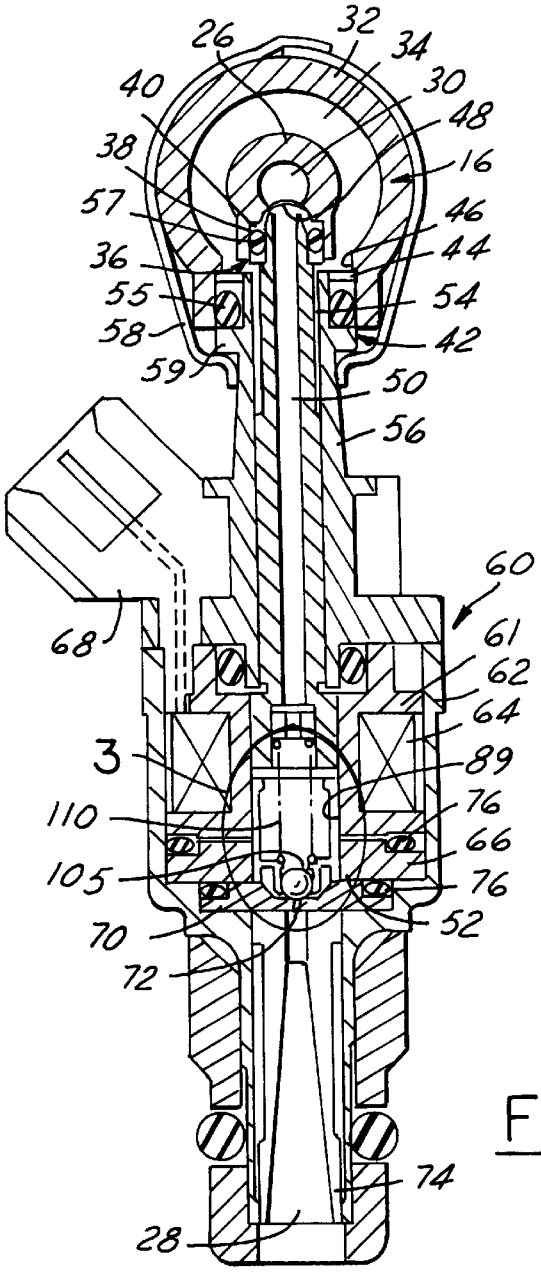
FIG. 2 is a sectional view of a fuel injector embodying this invention.

FIG. 2 illustrates a fuel injector 18 constructed to receive liquified fuel through a fuel inlet 26 communicating with the fuel rail 16 and deliver that fuel to the engine 12 through a fuel outlet 28. The fuel rail 16 preferably has a fuel supply passage 30 received within a fuel return conduit 32. The passage 34 through which fuel flows in the fuel return conduit 32 is defined between the exterior of the fuel supply passage 30 and the interior of the fuel return conduit 32. The fuel supply passage 30 preferably has a bore 36 in communication with the interior of the fuel supply passage 30 and a counterbore 38 which provides a shoulder 40 adjacent to the interior of the fuel supply passage 30. The fuel return conduit 32 also has a bore 42 in communication with its passage 34 and a counterbore 44 which provides a shoulder 46 adjacent its passage 34.

To prevent at least some contaminates from entering the fuel injector 18, it preferably has a filter 48 disposed downstream of the inlet 26 between the inlet 26 and a fuel passage 50 through the injector 18 which communicates the inlet 26 with the outlet 28. A valve 52 is disposed within the fuel passage 50 between the inlet 26 and outlet 28 of the fuel injector 18 and, when closed, prevents fuel flow through the fuel passage 50 to prevent fuel from being delivered from the fuel injector 18. Preferably, to return fuel to the tank 14 and prevent excessive pressure build-up in the fuel system 10 such as when fuel is being delivered to the injector 18 at a higher rate than needed to operate the engine or when the valve 52 is closed, a return fuel passage 54 is provided in communication with passage 34 within the return fuel conduit 34 of the fuel rail 16 which communicates with a return fuel line 35 to return fuel to the fuel tank 14. The return fuel passages 54 and 34 are preferably disposed closely adjacent to the fuel passage 50 within the fuel injector 18 and the fuel supply passage 30 of the fuel rail 16 to absorb heat from the passages 30 and 50 to cool the fuel within the passages 30 and 50 and maintain the supply fuel in a fully liquid state when delivered to the fuel injector 18 as disclosed in U.S. Pat. No. 5,291,869, the disclosure of which is incorporated herein by reference.

The fuel injector 18 has a main housing 56 which has one end partially received in the bore 42 adjacent the fuel return conduit 32 and adjacent the shoulder 46 of the counterbore 44 such that the return fuel passage 54 is in communication with the passage 34 of the fuel return conduit 32 of the fuel rail 16. Preferably, to prevent fuel leakage between the main housing 56 and the fuel return conduit 32 of the fuel rail 16, a sealing member 55 is disposed between them. An end of the fuel passage 50 is received within the bore 36 of the fuel supply passage 30 and extends adjacent the shoulder 40, communicating the fuel passage 50 and the fuel supply passage 30 of the fuel rail 16. A sealing member 57 is provided between the fuel passage 50 and the fuel supply passage 30 of the fuel rail 16 to prevent fuel leakage between them. A retaining clip 58 preferably has its open end rolled over a flange 59 extending from the main housing 56 to secure the fuel injector 18 adjacent to the fuel rail 16.

To open and close the valve 52, a solenoid assembly 60 is disposed adjacent the valve 52. The solenoid assembly 60 has a bobbin 61, a casing 62 which carries a coil 64 of electric wire and a ferromagnetic ring 66 encircling the valve 52. The coil 64 is electrically connected to a socket 68 for supplying electric power to the coil to energize the solenoid coil 64 to open the valve 52.

The fuel injector 18 preferably has a metering body 70 adjacent the valve 52 with a central metering orifice 72 therethrough accurately sized to consistently deliver a precise amount of fuel through the injector 18 when the valve 52 is open. The orifice 72 is preferably smaller in diameter than the fuel passage 50 and the outlet 28 creating a drop in pressure when the fuel flows through the orifice 72 which facilitates flow through the fuel passage of the fuel injector. To better disperse the fuel emitted from the fuel injector 18, the outlet 28 preferably has a diverging tapered portion 74 providing an increased diameter fuel passage adjacent the outlet 28 of the fuel injector 18. The metering body 70 is preferably received between the casing 62 on one side and the ferromagnetic ring 66 adjacent the other side. To prevent leakage of the fuel under pressure between the various components a sealing member 76 such as an O-ring is preferably disposed between the metering body 70 and the ferromagnetic ring 66 and between this ring and the bobbin 61. The drop in pressure associated with the flow through the orifice 72 causes the fuel to vaporize if it is at a sufficiently high temperature. Thus, the fuel flows through the valve 52 in a liquid state so that sufficient fuel will flow to the intake manifold of the engine 12 during the relatively short period of time when the valve 52 is open and even under engine maximum fuel demand conditions.

Figure 3:
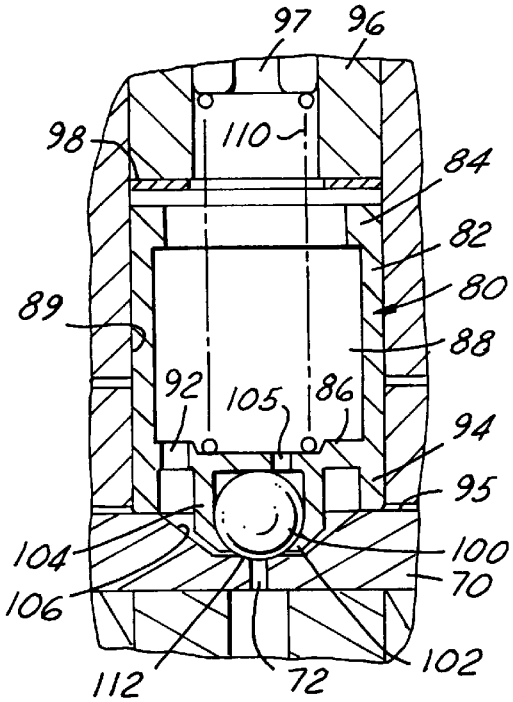
FIG. 3 is an enlarged view of the encircled portion in FIG. 2.

A preferred construction of the fuel injector valve 52 and metering body 70 is shown in FIG. 3. The valve 52 has a valve body 80 of a ferromagnetic material which is generally elongate, has a cylindrical side wall 82, an upper wall 84, a lower wall 86, and an inner cavity 88 between the upper wall 84 and lower wall 86. The valve body 80 is slidably received for reciprocation between open and closed positions within a cylindrical chamber 89 in communication with the fuel passage 50. To allow fuel to flow through the valve body 80, a plurality of openings are provided with at least one opening 90 in the upper wall 84 communicating the inner cavity with the fuel passage 50 and preferably several openings 92 in the lower wall 86 communicating the inner cavity 88 with the fuel passage downstream of the valve body 80. The side wall 82 extends beyond the lower wall 86 providing an annular ring 94 constructed to contact an adjacent face 95 of the metering body 70 to limit the axial travel of the valve 52 towards the metering body 70.

A bushing 96 is preferably disposed within the fuel injector housing 56 and has a central through hole 97 defining a portion of the fuel passage. The lower end 98 of the bushing 96 is disposed adjacent to the valve body 80 and, limits movement of the valve body 80 in the direction of the bushing 96. Preferably, to provide an insulating layer tending to dampen noise and vibration in the injector 18 when the valve is open and fuel is flowing therethrough, an elastomeric ring 99 is disposed between the bushing 96 and valve body 80.

A spherical valve head 100 is carried within a socket 102 of the valve body 80 extending from the lower wall 86 of the valve body 80. The valve head 100 extends slightly below an annular side wall 104 of the socket 102 to enable the valve head 100 to bear on the metering body 70 when the valve 52 is closed. The metering body 70 preferably has a cavity 106 formed therein and generally coaxial with the metering orifice 72 and constructed to receive the valve head 100 therein. Preferably, to limit the pressure differential across the valve head 100 which develops during initial opening and closing of the valve and which can effect the motion of the valve and hence, its dynamic flow characteristics, a vent port 105 is provided in the lower wall communicating the socket 102 with the inner cavity 88.

The valve 52 is preferably biased by a spring 110 to a closed position firmly engaging the valve head 100 with the metering body 70 to prevent flow through the metering orifice 72. The valve head 100 is preferably made of an elastomeric material which is flexible so that it is capable of being compressed to provide a sufficient seal of the metering orifice 72. The valve head material is also substantially resilient such that when the valve 52 is open, with the valve head 100 disengaged from the metering body 70, the valve head 100 returns to its original shape so that it can be compressed again when the valve 52 is closed and thereby seal the metering orifice 72. To prevent permanent deformation or wear of the valve head 100, the extent of compression of the valve head 100 does not exceed the elastic limit of the material of the valve head 100.

The metering body 70 is preferably beveled or rounded adjacent to the upstream edge 112 of the metering orifice 72 to prevent the metering body 70 from digging or cutting into the valve head 100 when the valve 52 is closed and the valve head 100 is compressed against the metering body 70. The rounded upstream edge 112 also provides a more uniform contact area or seat between the valve head 100 and the metering body 70 to provide a sufficient seal. Preferably, the maximum effective diameter of the edge 112 seat area is minimized and only slightly larger than the orifice 72 to minimize the force necessary to disengage the valve head 100 from the metering body 70. This is necessary because the force produced by a conventional solenoid 64 is relatively small and yet when the fuel injector 18 is used with high pressure gases such as LPG or CNG, the force supplied by the solenoid 64 must still be sufficient to accurately and consistently open the valve 52 to allow a precise amount of fuel to flow through the injector 18 while the valve 52 is open. At the same time the valve head 100 must provide a sufficient seal to prohibit leakage of the high pressure gas through the metering orifice 72 when the valve 52 is closed.

Operation

Liquid fuel is supplied from the fuel tank 14 through fuel supply lines 15 to the fuel rail 16 and associated fuel injectors 18. The fuel flows through the fuel inlet 26 of the fuel injector 18 through a fuel filter 48 and then into the fuel passage 50 of the injector 18. The fuel then flows through the opening 90 in the upper wall 84 of the valve body 80, through the inner cavity 88 of the valve body 80 and through the opening 92 in the lower wall 86 of the valve body 80 into the cavity 106 surrounding the valve head 100. Excess fuel not used by the injector is returned to the tank through the return fuel passage 54 and fuel return conduit 32 of the fuel rail 16.

Figure 4:
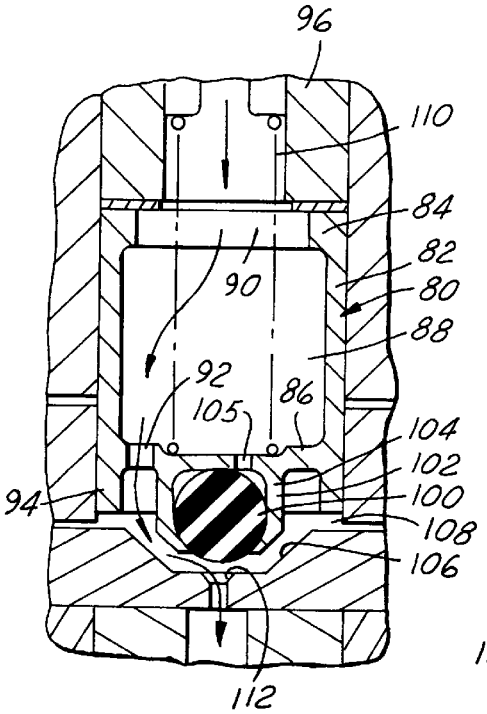
FIG. 4 is a fragmentary enlarged sectional view of the fuel injector valve in an open position.

When it is desired to emit fuel from the fuel injector 18, an electrical signal is sent from an engine computer processor unit (ECU) monitoring and controlling engine to activate the solenoid 60. The ECU monitors engine operating and fuel demand conditions and determines the quantity of fuel to be supplied to the operating engine. As shown in FIG. 4, valve body 80 is displaced by the magnetic flux of the energized solenoid coil 64 to disengage the valve head 100 from the metering body 70 and permit fuel flow through the metering orifice 72 as shown in FIG. 4. After a predetermined amount of time has passed such that the precise amount of fuel has passed through the metering orifice 72, the current activating the solenoid 60 is interrupted and thus, the force holding the valve 52 open no longer exists and the valve 52 closes. To close the valve, the spring 110 moves the valve body 80 towards the metering body 70 until the annular ring 94 contacts the face 108 of the metering body 70 and the valve head 100 is firmly engaged with and slightly compressed against the metering body 70 sealing the metering orifice 72. In this manner, the flow of fuel through the fuel injector 18 is controlled throughout the service life of the fuel injector 18 which can be up to about one billion cycles.

Second Embodiment

Figure 5:
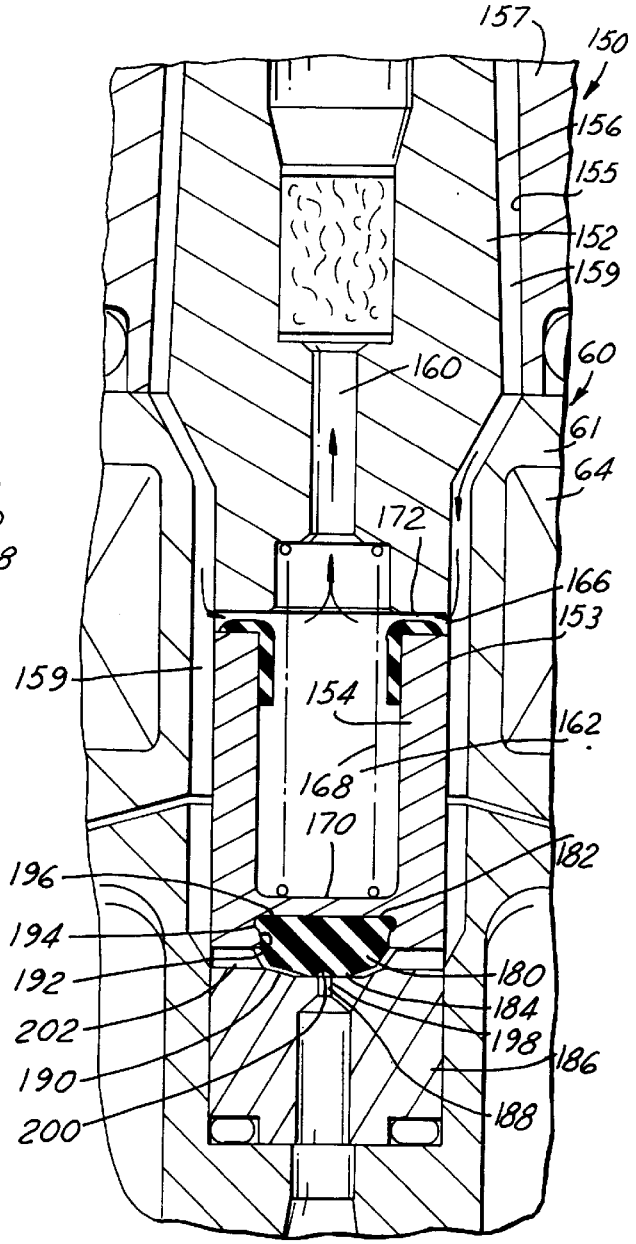
FIG. 5 is a fragmentary sectional view of an alternate embodiment of a fuel injector of this invention.
Figure 6:
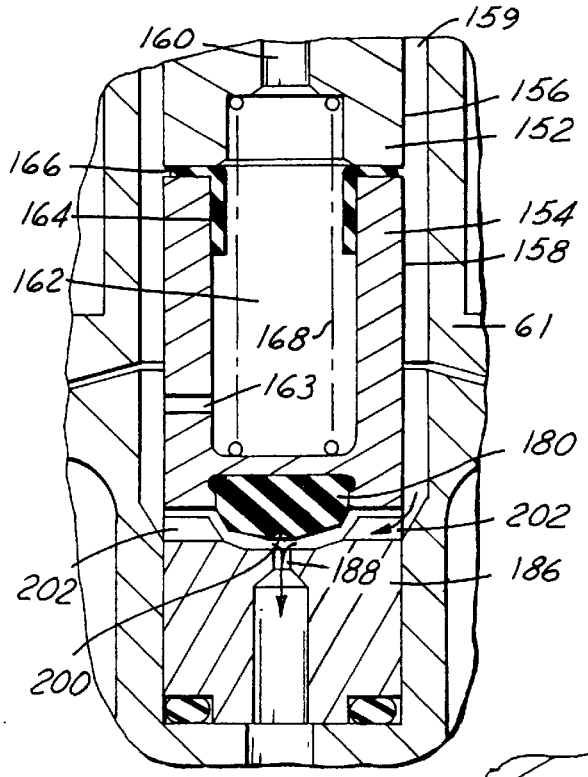
FIG. 6 is a fragmentary sectional view illustrating the fuel injector valve of FIG. 5 in an open position.

FIG. 5 shows an alternate embodiment 150 of this invention. An annular bushing 152 and an annular valve body 154 are disposed generally concentrically within a bore 155 within the fuel injector housing 157 and through the bobbin 61 of the solenoid assembly 60. Slots formed either in the housing 157 and bobbin 61 or in the bushing 152 and valve body 154 provide longitudinally extending fuel passages 159. A central return fuel passage 160 is formed coaxially within the bushing 152 and communicates with a central cavity 162 of the valve body 154. A passage 163 communicates the central cavity 162 with the fuel passage 159. An annular and preferably elastomeric ring 164 disposed within the central cavity 162 of the valve body 154 has a radially extending flange 166 overlapping the upper end of the valve body 154 and disposed between a lower end of the bushing 152 and the upper end of the valve body 154. A spring 168 is attached adjacent to the lower end of the bushing 152 and the bottom wall 170 of the central cavity 162 of the valve body 154 to bias the valve to a closed position. This provides a gap 172 between the bushing 152 and the valve body 154 through which fuel can flow.

The valve head 180 is made of a generally flexible and substantially resilient material and has a substantially flat face 182 adjacent one end and is generally dome-shaped providing a reduced diameter tip 184 constructed to firmly engage the metering body 186 to seal the metering orifice 188. The metering body 186 preferably has a valve head cavity 190 generally complementarily shaped to the valve head 180 to receive the valve head 180 which extends beyond the lower end of the valve body 154. The valve body 154 preferably has a generally circular and beveled recess 192 with a tapered side wall 194 which extends upwardly and outwardly to a generally flat end face 196 of the recess 192 as viewed in FIG. 5. The valve head 180 is preferably press-fit into the recess 192 or insert molded therein to attach the valve head 180 to the valve body 154. This firmly attaches the valve head 180 to the valve body 154 to facilitate accurate and consistent disengagement of the valve head 180 from the metering body 186.

To more accurately size the metering orifice 188 it has a generally straight edge 198 which is not beveled or rounded adjacent its upstream end. Preferably, to prevent this edge 198 from cutting or digging into the valve head 180 when the valve is closed and to prevent wear of the edge 198, the valve head 180 has a dome shaped recess or cavity 200 formed therein and constructed to encircle the metering orifice 188 so the valve head 180 contacts the metering body 186 in a circumferential area surrounding and spaced from the metering orifice 188.

Operation of the Second Embodiment

The valve is biased to a normally closed position by the spring 168 received between the valve body 154 and the bushing 152. Liquid fuel flows through the fuel passage 159, through the gap 172 between the valve body 154 and the bushing 152, and through the return fuel passage 160 formed in the bushing 152. Fuel also flows through the passage 163 in the central cavity 162 to the fuel passage 159. When it is desired to emit fuel from the fuel injector 150 the solenoid 64 is activated by an electrical signal as in the preferred embodiment and creates a force acting to slidably displace the valve body 154 and disengage the valve head 180 from the metering body 186 which allows fuel flow through the metering orifice 188. The movement of the valve body 154 engages the flange 166 with the bushing 152 which limits the axial travel of the valve body 154 and also provides vibration and sound dampening within the fuel injector 150 adjacent the bushing 152 and the valve body 154 when the valve is open.

To stop fuel delivery from the fuel injector 150, the electric current activating the solenoid 64 is interrupted and thus, the force holding the valve open is no longer created and the valve closes. The spring 168 moves the valve to its closed position where the valve body 154 engages the metering body 186 causing the valve head 180 to be slightly compressed between the valve body 154 and the metering body 186 to thereby seal the metering orifice 188 and prevent fuel flow therethrough. Preferably, a plurality of slots 202 are formed in the metering body 186 circumferentially and radially spaced adjacent the cavity 190 of the metering body 186. The slots 202 communicate the valve head cavity 190 with the fuel passage 159 and lessens the pressure differential across the metering body 186 when closed to facilitate initial opening of the valve.

Third Embodiment

Figure 7:
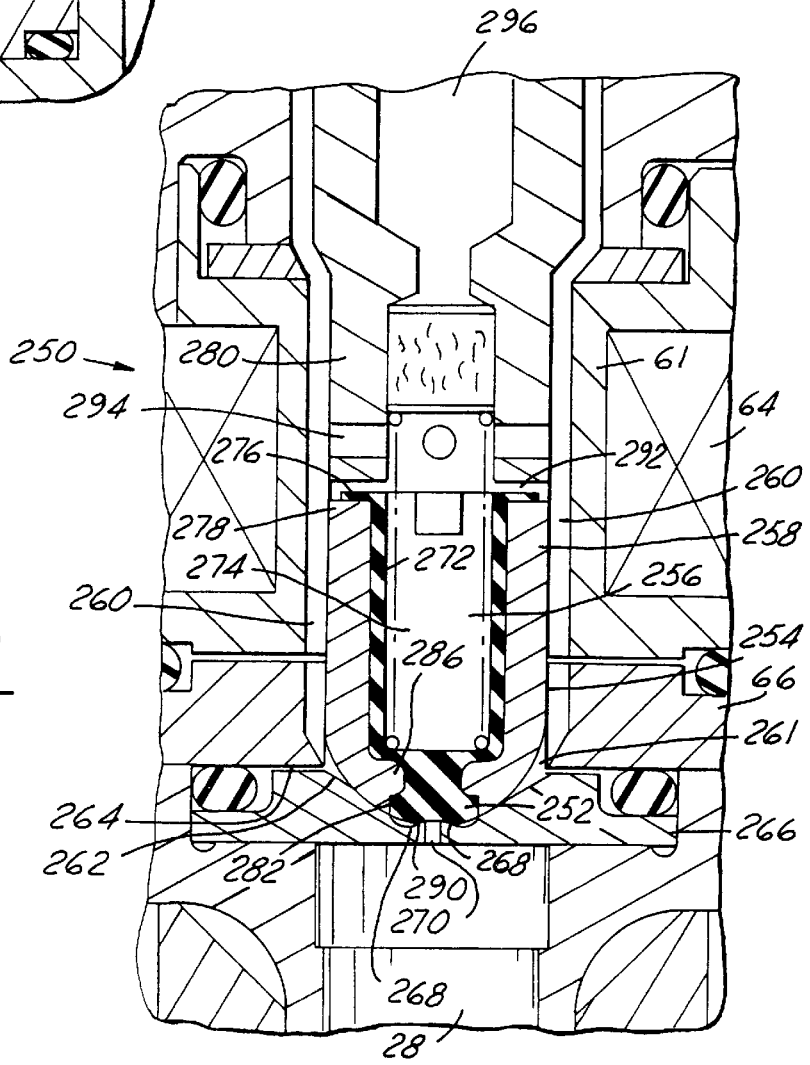
FIG. 7 is a fragmentary sectional view of a third embodiment of a fuel injector of this invention.

FIG. 7 shows a third embodiment 250 of this invention having a valve head 252 formed of a generally flexible and substantially resilient material molded within a ferromagnetic valve body 254. The valve body 254 has a central bore 256 therethrough, a generally cylindrical side wall 258, and is disposed generally concentrically within a bore 259 through a housing 261, the bobbin 61 and the ferromagnetic ring 66. The lower end 261 of the valve body 254 is generally arcuate or dome shaped and is constructed to mate with a generally frusto conical recess 262 formed in the adjacent face 264 of the metering body 266. The metering body 266 preferably has a raised dome shaped contact portion 268 adjacent the metering orifice 270 constructed to minimize the contact area between the valve head 252 and metering body 266.

The valve head 252 is generally elongate and received within the central bore 256 of the valve body 254. The valve head 252 has an annular and longitudinally extending side wall 272 with a cavity 274 formed therein and a radially extending flange 276 adjacent to and overlapping a portion of the upper edge 278 of the valve body 254 providing an isolating layer between a bushing 280 and the valve body 254. Slots formed preferably in the sidewall of the bushing 280 and the valve body 254 define longitudinally extending fuel passages 260. The lower portion of the valve head 252 has an annular groove 282 providing a shoulder 284 adjacent each side of the groove 282 and is engaged by an inwardly extending rib 286 of the valve body 254 to attach the valve head 252 to the valve body 254 to move in unison therewith. The valve head 252 has a tip 288 extending from the groove 282 and extending slightly beyond the lower end of the valve body 254 to permit the valve head 252 to contact the metering body 266 and be compressed to seal the metering orifice 270. The tip 288 is preferably generally round or semi-spherical and deformable against the contact portion 268 of the metering body 266 to provide a seal between them when engaged.

To limit the compression of the valve head 252 between the valve body 254 and the metering body 266, the lower end 261 of the valve body 254 contacts the recess 262 of the metering body 266 when the valve closes. As in the other embodiments, the deformation of the valve head 252 is within the elastic limits of the valve head material to prevent permanent deformation or wear of the valve head and thereby ensures the ability of the valve head to repeatably seal the metering orifice 270.

Operation of the Third Embodiment

The valve is spring biased to a closed position wherein the tip 288 of the valve head 252 is firmly engaged with the metering body 266 and slightly compressed between the valve body 254 and the metering body 266 and a gap 292 is created between the bushing 280 and the valve head 252. Fuel flows through the fuel passage 260 and adjacent the side wall 258 of the valve body 254 where the seal between the valve head 252 and metering body 266 prevents fuel flow through the metering orifice 270. When it is desired to deliver fuel from the fuel injector 250, an electrical signal is provided to activate the solenoid 64 and displace the valve body 254 thereby disengaging the valve head 252 from the metering body 266. The valve body is moved against the bias of the spring until the flange 276 of the valve head 252 contacts the bushing 280. Excess fuel is returned through ports 294 formed in the bushing 280 and in communication with a fuel return passage 296. When the solenoid 64 is deactivated the spring force moves the valve body 254 into engagement with the metering body 266 and thus, seals the valve head 252 adjacent the metering orifice 270 of the metering body 266 to prevent fuel flow therethrough.

We claim:

1. A liquified gas fuel injector of an engine comprising:

a main body;

a fuel passage through the body;

a fuel inlet in communication with the fuel passage;

a fuel outlet communicating the fuel passage with the exterior of the body to deliver fuel from the injector;

a valve selectively communicating the fuel outlet with the fuel passage and having a valve body, a valve head carried by the body and formed of a generally flexible and substantially resilient elastomer material and a valve seat adjacent to the fuel outlet whereby the valve head is selectively engageable with the valve seat and at least slightly deformable against the valve seat to provide a seal therebetween to prevent fuel flow through the valve; and a stop engageable with the valve body to limit the deformation of the valve head between the valve body and valve seat.

2. The fuel injector of claim 1 which also comprises a solenoid coil encircling and adjacent to the valve body, the valve body being of a ferromagnetic material and when the coil is energized the valve body is displaced to open the valve.

3. The fuel injector of claim 1 wherein the valve head is generally spherical and has a diameter sufficient to completely close the fuel passage.

4. The fuel injector of claim 1 wherein the valve body is spring biased to firmly engage the valve head with the valve seat to prevent fuel flow through the fuel outlet.

5. The fuel injector of claim 1 which also comprises a metering body, the fuel passage is at least partially formed by an orifice through the metering body, the valve seat is carried by the metering body, and the valve head has a recess formed therein so that the valve head contacts the metering body around the perimeter of the orifice to provide a circumferentially continuous seal around and spaced from an edge of the orifice to prevent wear of the valve head by the edge of the orifice.

6. The fuel injector of claim 1 wherein the valve head has a generally dome-shaped bottom wall constructed to engage the valve seat over a limited surface area to reduce the force needed to separate them.

7. The fuel injector of claim 1 wherein a second stop is provided adjacent the end of the valve body opposite the valve head to limit the travel of the valve body in the direction of the second stop.

8. The fuel injector of claim 7 wherein an elastomeric ring is disposed between the valve body and the second stop tending to dampen noise or vibration within the fuel injector when the valve is open.

9. The fuel injector of claim 8 wherein the elastomeric ring and the valve head are integrally molded together.

10. The fuel injector of claim 1 wherein the valve body has an annular recess with a tapered side wall constructed to receive a complementary shaped valve head therein to connect the valve head with the valve body.

11. The fuel injector of claim 10 wherein the valve head is maintained within the recess by a press fit.

12. A liquified gas fuel injector of an engine comprising:

a main body;

a fuel passage through the body;

a fuel inlet in communication with the fuel passage;

a fuel outlet communicating the fuel passage with the exterior of the body to deliver fuel from the injector;

a valve selectively communicating the fuel outlet with the fuel passage and having a valve head formed of a generally flexible and substantially resilient material and a valve seat adjacent to the fuel outlet whereby the valve head is selectively engageable with the valve seat providing a seal therebetween to prevent fuel flow through the valve; and a metering body, the fuel passage being at least partially formed by an orifice through the metering body, the valve seat being carried by the metering body, and the valve head having a recess formed therein so that the valve head contacts the metering body around the perimeter of the orifice to provide a circumferentially continuous seal around and spaced from an edge of the orifice to prevent wear of the valve head by the edge of the orifice.

13. The fuel injector of claim 12 which also comprises a valve body received for reciprocation within the fuel passage, the valve head being carried by the valve body, and a solenoid coil encircling and adjacent to the valve body, and the valve body being of a ferromagnetic material and when the coil is energized the valve body is displaced to open the valve.

14. The fuel injector of claim 12 wherein the valve head has a generally dome-shaped bottom wall constructed to engage the valve seat over a limited surface area to reduce the force needed to separate them.

15. The fuel injector of claim 12 wherein a second stop is provided adjacent the end of the valve body opposite the valve head to limit the travel of the valve body in the direction of the second stop.

16. The fuel injector of claim 12 wherein the valve body has an annular recess with a tapered side wall constructed to receive a complementary shaped valve head therein to connect the valve head with the valve body.

17. The fuel injector of claim 16 wherein the valve head is maintained within the recess by a press fit.

* * * * *